US012410810B2

(12) United States Patent
Lee et al.

(10) Patent No.: US 12,410,810 B2
(45) Date of Patent: Sep. 9, 2025

(54) WATER PUMP

(71) Applicant: COAVIS, Sejong-si (KR)

(72) Inventors: Hyuntae Lee, Sejong-si (KR); Sungwoong Park, Cheonan-si (KR); Seongjin Son, Ulsan (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 19/057,646

(22) Filed: Feb. 19, 2025

(65) Prior Publication Data

US 2025/0264110 A1 Aug. 21, 2025

(30) Foreign Application Priority Data

Feb. 19, 2024 (KR) ..... 10-2024-0023473

(51) Int. Cl.
*F04D 29/22* (2006.01)
*F04D 1/00* (2006.01)
*F04D 13/06* (2006.01)

(52) U.S. Cl.
CPC ..... *F04D 29/2205* (2013.01); *F04D 1/00* (2013.01); *F04D 13/06* (2013.01)

(58) Field of Classification Search
CPC .... F04D 29/2205; F04D 29/046; F04D 29/22; F04D 29/4293; F04D 29/043; F04D 29/426; F04D 29/5806; F04D 29/628; F04D 29/669; F04D 1/00; F04D 13/06; F04D 13/08; F04D 13/0606; F04D 13/0633; F05D 2210/11
See application file for complete search history.

(56) References Cited

U.S. PATENT DOCUMENTS 7,699,588 B2 * 4/2010 Mendler ..... A61M 60/81 417/423.1
11,339,804 B2 * 5/2022 Pohler ..... F04D 7/02
11,781,566 B1 * 10/2023 Kim ..... B29C 66/322 415/182.1
2006/0247486 A1 * 11/2006 Mendler ..... A61M 60/232 600/16

(Continued)

FOREIGN PATENT DOCUMENTS

KR 19970006923 2/1997
KR 20150052436 5/2015
KR 101651349 8/2016

(Continued)

*Primary Examiner* — Dapinder Singh
(74) *Attorney, Agent, or Firm* — Thorpe North & Western, LLP; David W. Osborne

(57) ABSTRACT

The present disclosure relates to a water pump in which an upper casing and a lower casing are coupled to each other and an impeller is rotatably accommodated therein, in which the upper casing has an upper bulkhead formed to protrude at a position between an impeller accommodating space and a discharge channel in a radial direction, the lower casing has a lower bulkhead formed to protrude at a position between the impeller accommodating space and the discharge channel in the radial direction, and a gap (TcA) between an upper side of an outer side end of the impeller and the upper bulkhead in the radial direction is formed greater than a gap (TcB) between a lower side of the outer side end of the impeller and the lower bulkhead in the radial direction, thereby reducing a thrust generated when the impeller rotates.

11 Claims, 9 Drawing Sheets

(56) References Cited

U.S. PATENT DOCUMENTS

2024/0052844 A1* 2/2024 Lee ..... F04D 29/22

FOREIGN PATENT DOCUMENTS

| | | |
|---|---|---|
| KR | 20180004634 | 1/2018 |
| KR | 20180054954 | 5/2018 |
| KR | 20200111514 | 9/2020 |
| KR | 20210059813 | 5/2021 |

* cited by examiner

WATER PUMP

CROSS-REFERENCE TO RELATED APPLICATIONS

This application claims priority under 35 U.S.C. § 119 to Korean Patent Application No. 10-2024-0023473, filed on Feb. 19, 2024, in the Korean Intellectual Property Office, the disclosure of which is incorporated herein by reference in its entirety.

TECHNICAL FIELD

The following disclosure relates to a water pump capable of pressure-feeding a coolant by rotating an impeller.

BACKGROUND

A water pump is a device for circulating a coolant to an engine or a heater in order to cool the engine or heat an interior. Such a water pump is mainly divided into a mechanical water pump and an electric water pump.

The mechanical water pump is a pump connected to a crankshaft of an engine and driven according to the rotation of the crankshaft, and the electric water pump is a pump driven by the rotation of a motor controlled by a control device.

FIG. 1 is a front cross-sectional view illustrating an example of a conventional electric water pump.

Referring to FIG. 1, the conventional electric water pump largely includes a housing 10, a stator 20, a can 30, a rotor 40, a rotation shaft 41, a lower bearing 42, an upper bearing 43, an impeller 50, and an upper casing 60.

More specifically, the stator 20 is provided inside a housing 10 in which a concave accommodating space is formed, a protrusion formed convexly downward of the can 30 is inserted so as to pass through a central portion of the stator 20, and an upper portion of the can 30 is coupled to an upper end portion of the housing 10. In addition, a concave space is formed on the inside of the protrusion portion of the can 30, the rotor 40 is disposed inside the space, and both end portions of the rotation shaft 41 coupled to the rotor 40 are coupled to and supported by the lower bearing 42 and the upper bearing 43. In addition, the upper casing 60 is coupled to the upper portion of the can 30, the impeller 50 is provided in the internal space formed by the coupling of the can 30 and the upper casing 60, and the impeller 50 is configured to be coupled to the rotation shaft 41 and rotate together with the rotor 40. Thus, the fluid introduced into the inlet pipe 61 formed in the upper casing 60 by the rotation of the impeller 50 may be pressurized through the impeller 50 and then discharged through an outlet pipe 62 formed in the upper casing 60.

However, when the impeller 50 rotates, some of the fluid discharged from the impeller 50 flows between a lower surface of the impeller 50 and the can 30, and pressure is applied. Another portion of the fluid discharged from the impeller 50 flows between an upper surface of the impeller 50 and the upper casing 60 and returns to the inlet side of the impeller 50. In this case, since the fluid pressure between the upper surface of the impeller 50 and the upper casing 60 is lower than that between the lower surface of the impeller 50 and the can 30, an upward thrust is generated that causes the impeller 50 and the rotor 40 to move axially upward.

Due to the upward thrust, the performance and efficiency of the water pump are reduced, and friction increases in the bearings, etc., that support the rotation shaft of the rotor in the axial direction, resulting in a problem of reduced durability.

RELATED ART DOCUMENT

Patent Document

KR 10-2015-0052436 A (2015.05.14.) "Water pump"

SUMMARY

An embodiment of the present disclosure is directed to providing a water pump capable of improving performance and efficiency by reducing a thrust generated when an impeller rotates.

In one general aspect, a water pump includes: an upper casing and a lower casing that are coupled to each other to form an impeller accommodating space in which an impeller is rotatably accommodated, provided with an inlet communicating with the impeller accommodating space on an upper side of the impeller accommodating space to allow fluid to be introduced, a discharge channel communicating with the impeller accommodating space on an outer side of the impeller accommodating space in a radial direction, and an outlet connected to the discharge channel to discharge the fluid to the outside; and an impeller that is rotatably provided in the impeller accommodating space, in which the upper casing has an upper bulkhead formed to protrude at a position between the impeller accommodating space and the discharge channel in the radial direction, and the lower casing has a lower bulkhead formed to protrude at a position between the impeller accommodating space and the discharge channel in the radial direction, and a gap (TcA, or "first" gap) between an upper side of an outer end of the impeller and the upper bulkhead in the radial direction is formed greater than a gap (TcB, or "second" gap) between a lower side of an outer side end of the impeller and the lower bulkhead in the radial direction.

A gap (TcC, or "third" gap) between an upper end of an inner side of the impeller and the upper casing in the radial direction may be formed to be smaller than or equal to the gap (TcB) between the lower side of the outer side end of the impeller and the lower bulkhead in the radial direction.

In an area adjacent to the position of the outer side end of the impeller in the radial direction, a gap (AcA, or "fourth" gap) between an upper surface of the impeller and a lower surface of the upper casing in an axial direction may be formed to be greater than or equal to a gap (AcB, or fifth) between a lower surface of the impeller and an upper surface of the lower casing in the axial direction.

A pressure chamber may be formed concavely upward from the lower surface of the upper casing in a portion of an area of the inside in the radial direction based on the upper bulkhead of the upper casing.

The upper bulkhead may be disposed radially outward from the lower bulkhead.

The lower side of the outer side end of the impeller in the radial direction may protrude radially outward from the upper side of the outer side end.

The impeller may include an upper plate and a lower plate spaced apart from each other, and a plurality of blades that are interposed and coupled between the upper plate and the lower plate and arranged spaced apart from each other along a circumferential direction, and the upper bulkhead may be formed with a height corresponding to the upper plate of the impeller, and the lower bulkhead may be formed with a height corresponding to the lower plate of the impeller.

An outer side end of the lower plate of the impeller in the radial direction may protrude radially outward from an outer side end of the upper plate in the radial direction and outer side ends of the plurality of blades in the radial direction.

The impeller may be a centrifugal impeller.

The water pump may further include a rotor that is provided in a rotor accommodating part and coupled to the impeller, in which the lower casing may have the rotor accommodating part formed concavely from the upper surface to a lower side in a central portion, and may be formed protruding downward.

The water pump may further include: a motor housing that is formed in a concave container shape with an open upper side and coupled to the lower casing; and a stator that is provided inside the motor housing and coupled to the rotor accommodating part of the lower casing inserted into a central portion.

DETAILED DESCRIPTION OF MAIN ELEMENTS

Figure 1:
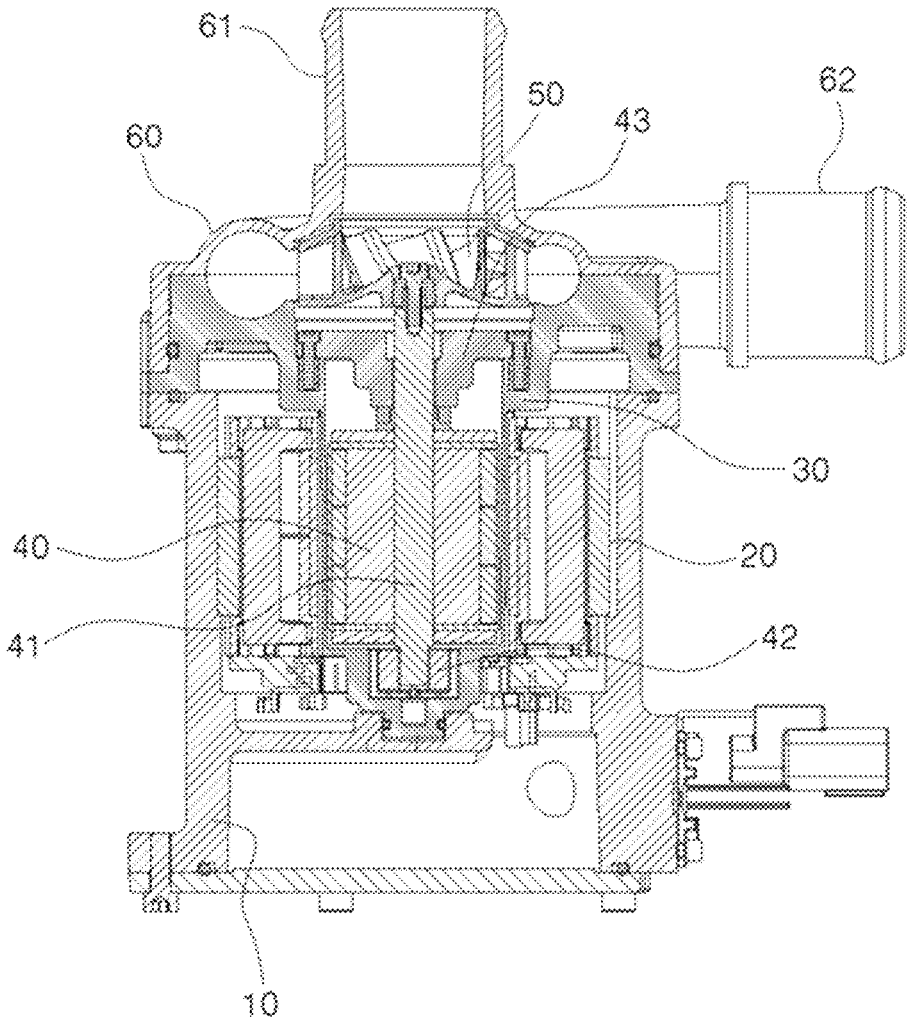
FIG. 1 RELATED ART
FIG. 1 is a front cross-sectional view illustrating an example of the conventional electric water pump in accordance with the prior art.

100: Stator
200: Lower casing
210: Lower seating groove
211: Lower bulkhead
212: Lower flow path groove
220: Rotor accommodating part
221: Rotor accommodating space
222: Lower bearing mounting part
300: Motor housing
400: Rotor
410: Rotation shaft
411: Lower bearing
412: Upper bearing
420: Insertion groove
B: Bushing
P: Support pin
S: Ball
500: Impeller
510: Upper plate
520: Lower plate
521: Protrusion
530: Blade
600: Upper casing
601: Impeller accommodating space
602: Upper bearing mounting part
610: Inlet
612: Support
620: Outlet
630: Upper seating groove
631: Upper bulkhead
632: Upper flow path groove
635: Pressure Chamber

DETAILED DESCRIPTION OF EMBODIMENTS

Hereinafter, a water pump according to the present disclosure will be described in detail with reference to the accompanying drawings.

Figure 2:
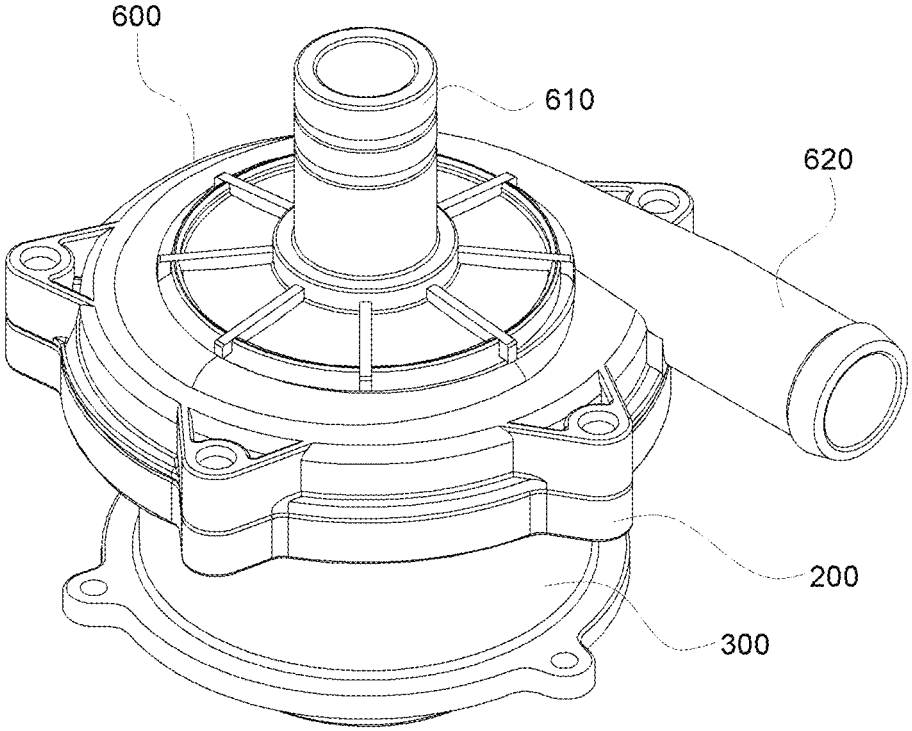
FIGS. 2 and 3 are an assembled perspective view and an exploded perspective view illustrating a water pump according to an embodiment of the present disclosure.
Figure 3:
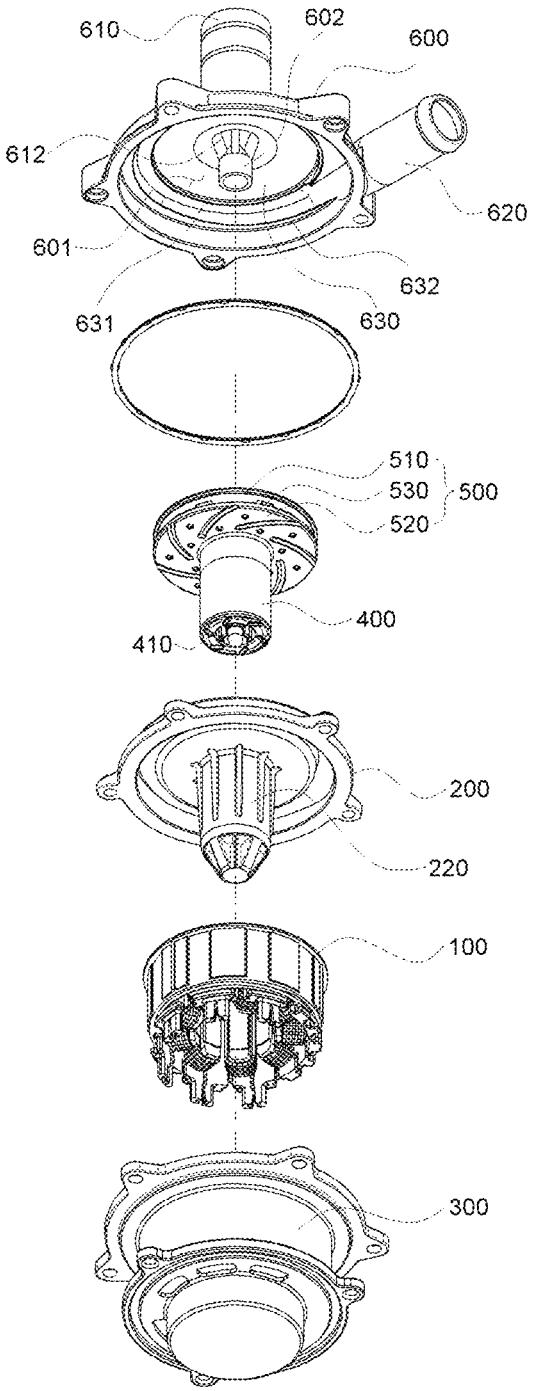
Figure 4:
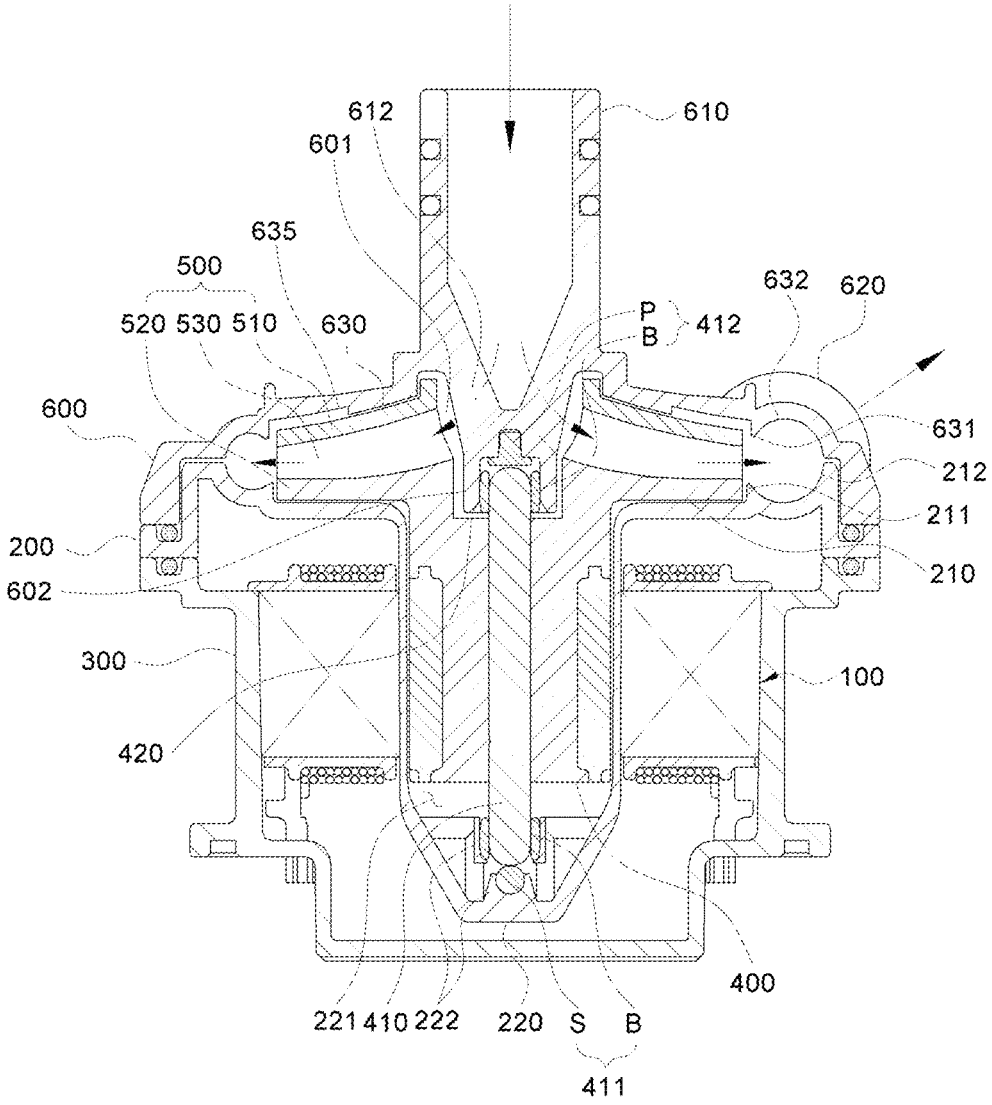
FIG. 4 is a front cross-sectional view illustrating the water pump according to a first embodiment of the present disclosure.
Figure 5:
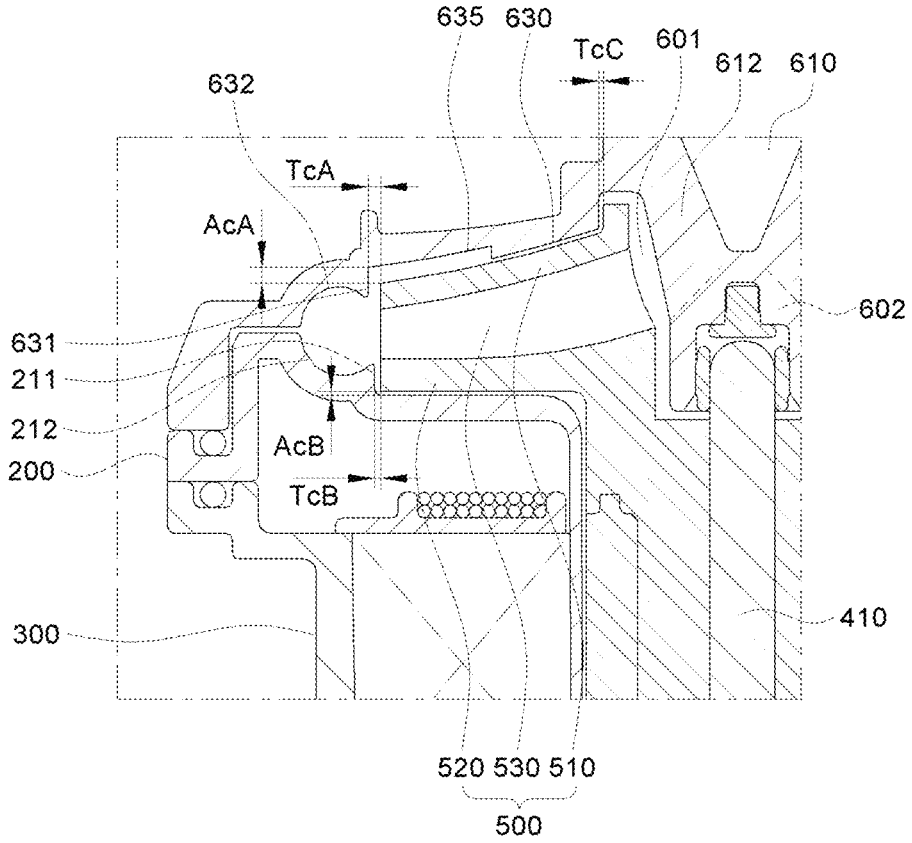
FIG. 5 is a partial enlarged view of FIG. 4.

FIGS. 2 and 3 are an assembled perspective view and an exploded perspective view illustrating a water pump according to an embodiment of the present disclosure, FIG. 4 is a front cross-sectional view illustrating the water pump according to a first embodiment of the present disclosure, and FIG. 5 is a partial enlarged view of FIG. 4.

As illustrated, the water pump according to the first embodiment of the present disclosure may be largely configured to include a lower casing 200, an upper casing 600, and an impeller 500. In addition, the water pump according to the first embodiment of the present disclosure may further include a rotor 400, a motor housing 300, and a stator 100.

The upper casing 600 may have an upper seating groove 630 formed concavely upward from the lower surface so that a part of the impeller 500 may be inserted. On a lower surface of the upper casing 600, an upper flow path groove 632 is concavely formed on an outer side of the upper seating groove 630 in a radial direction, so that the fluid discharged from the impeller 500 may flow along the upper flow path groove 632. Here, the upper seating groove 630 and the upper flow path groove 632 may be formed adjacent to each other but spaced apart from each other. The upper seating groove 630 and the upper flow path groove 632 radially communicate with each other, but a part of the area may be partitioned in the vertical direction by an upper bulkhead 631 at a position therebetween. The upper casing 600 has the inlet 610 formed therein through which the fluid is introduced, and for example, an outlet 620 formed therein through which the fluid flows out may be formed in the upper casing 600. In addition, the upper casing 600 is provided with the inlet 610 disposed in an upper central portion thereof, and the inlet 610 communicates with an impeller accommodating space 601, and the outlet 620 may be connected to an end of the upper flow path groove 632 to communicate.

The lower casing 200 is coupled to a lower side of the upper casing 200, and the impeller accommodating space 601 in which the impeller 500 may be accommodated is formed in the inside between the upper casing 600 and the lower casing 200 by the coupling between the upper casing 600 and the lower casing 200. The lower casing 200 may have a lower seating groove 210 formed downwardly concavely from an upper surface thereof so that a lower portion of the impeller 500 may be accommodated therein, and may have a lower flow path groove 212 concavely formed outside the lower seating groove 210 in a radial direction so that a fluid discharged from the impeller 500 may flow. Here, the lower flow path groove 212 may be formed adjacent to but spaced apart from the lower seating groove 210. In addition, the lower seating groove 210 and the lower flow path groove 212 may be radially connected, but a portion of the upper and lower area may be partitioned at a position therebetween by a lower bulkhead 211.

The impeller 500 is provided in the impeller accommodating space 601, which is an internal space formed by the combination of the upper casing 600 and the lower casing 200, and the impeller 500 is connected to the rotor 400 so that the impeller 500 may rotate together with the driving of the rotor 400. For example, the impeller 500 may be, for example, a centrifugal impeller. The impeller 500 may include an upper plate 510, a lower plate 520, and a plurality of blades 530, and the plurality of blades 530 are arranged to be spaced apart from each other in a circumferential direction between the upper plate 510 and the lower plate 520 vertically spaced apart from each other. In addition, a through hole penetrating through both sides of the upper plate 510 vertically is formed in the central portion of the upper plate 510, and the inside of the impeller 500 communicates with the inlet channel 611 through the through hole. In addition, an outer peripheral surface of the impeller 500 is disposed adjacent to the lower flow path groove 212 and the upper flow path groove 632, which are discharge channels, an outer peripheral surface of the upper plate 510 and the upper bulkhead 631 may be spaced apart from each other with a specific gap in the radial direction, and the outer peripheral surface of the lower plate 520 and the lower bulkhead 211 may be spaced apart from each other with a specific gap in the radial direction. In addition, for example, the impeller 500 may be formed in a shape in which the blades 530 and the lower plate 520 are formed integrally with a core part of the rotor 400 and the upper plate 510 is coupled to upper sides of the blades 530. In addition, the impeller may be formed in various shapes. Thus, the fluid introduced into the inlet 610 of the upper casing 600 may flow into the inside of the impeller 500 through the through hole formed in the upper plate 510 of the impeller 500. Thereafter, the fluid pressurized by the centrifugal force resulting from the rotation of the impeller 500 may flow along the discharge channel formed by the upper flow path groove 632 of the upper casing 600 and the lower flow path groove 212 of the lower casing 200 and then be discharged to the outside through the outlet 620. In addition, an upper surface of the upper plate 510 of the impeller 500 and the upper seating groove 630, which is a lower surface of the upper casing 600, may be spaced apart from each other with a specific gap in the axial direction, and a lower surface of the lower plate 520 of the impeller 500 and the lower seating groove 212, which is an upper surface of the lower casing 200, may be spaced apart from each other with a specific gap in the axial direction. The radial direction may be the radial direction of the impeller 500, and the axial direction may be the direction of the rotation shaft 410, which is the central axis of the impeller 500.

Here, a gap TcA between an upper side of an outer side end of the impeller 500 and the upper bulkhead 631 in the radial direction may be formed to be greater than a gap TcB between a lower side of the outer side end of the impeller 500 and the lower bulkhead 211 in the radial direction (TcA>TcB). The upper side of the outer side end of the impeller 500 may be the outer peripheral surface of the upper plate 510, and the lower side of the outer side end of the impeller 500 may be the outer peripheral surface of the lower plate 520. In addition, the gap TcA may be a minimum gap between the upper side of the outer side end of the impeller and the upper bulkhead in the radial direction, and the gap TCB may be a minimum gap between the lower side of the outer side end of the impeller and the lower bulkhead in the radial direction.

Thus, when the impeller 500 rotates, the fluid introduced through the inlet 610 passes through the impeller 500 and then flows in the circumferential direction along the space formed by the upper flow path groove 632 and the lower flow path groove 212, which are the discharge channels, and then is pressurized and discharged to the outside through the outlet 620. The pressure of the fluid discharged from the impeller 500 and introduced between the lower plate 520 and the lower casing 200 of the impeller 500 generates an upward thrust that causes the impeller 500 and the rotor 400 to move axially upward. In this case, since the gap TcA between the outer peripheral surface of the upper plate 510 of the impeller 500 and the upper bulkhead 631 is greater than the gap TcB between the lower side of the outer side end of the impeller 500 and the lower bulkhead 211, the pressure of the fluid flowing between the upper plate 510 of the impeller 500 and the upper casing 600 through the gap TcA between the outer peripheral surface of the upper plate 510 and the upper bulkhead 631 increases, thereby generating a downward thrust that pushes the impeller 500 and the rotor 400 axially downward. In other words, the upward thrust is offset by the downward thrust, and as a result, the generation of the thrust may be reduced.

Figure 6:
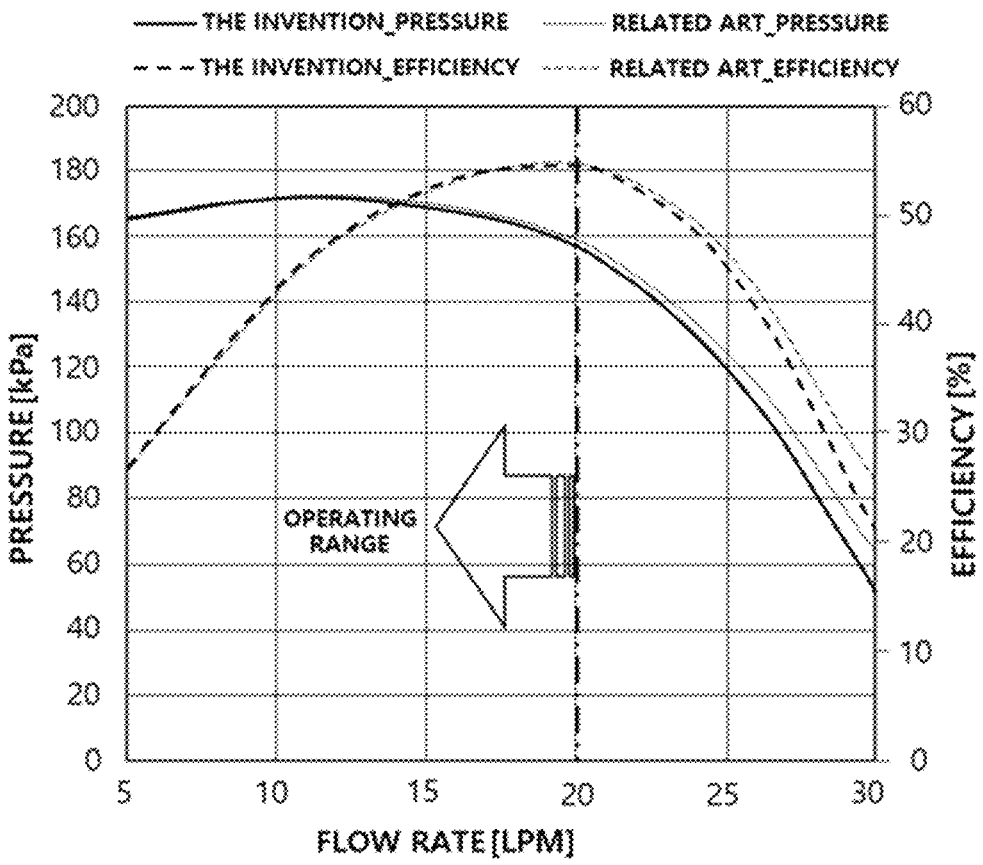
FIGS. 6 and 7 are graphs comparing the pressure, efficiency, and thrust of the water pump of the present disclosure and the conventional water pump according to the flow rate, which is analyzed by simulating the flow of the fluid using a computational fluid dynamics (CFD) program.
Figure 7:
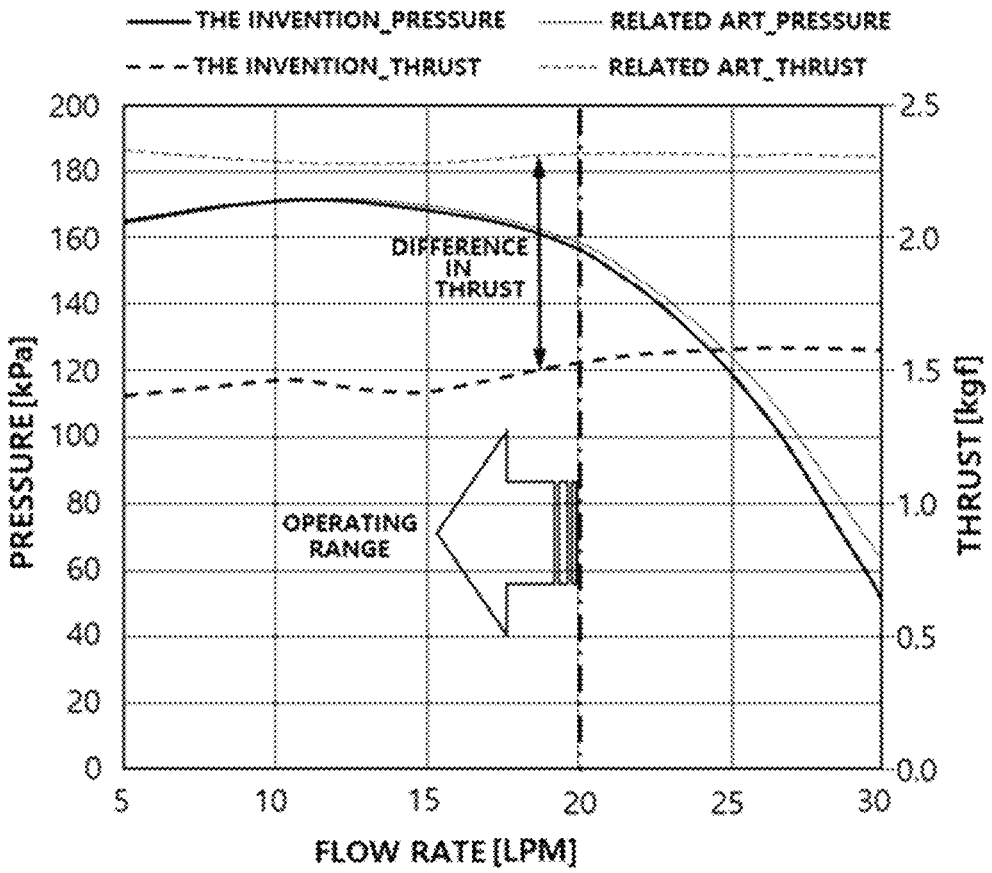

FIGS. 6 and 7 are graphs comparing the pressure, efficiency, and thrust of the water pump of the present disclosure and the conventional water pump according to the flow rate, which is analyzed by simulating the flow of the fluid using a computational fluid dynamics (CFD) program.

As illustrated, it may be seen that the water pump of the present disclosure significantly reduces the thrust while the pressure and efficiency are hardly reduced compared to the conventional water pump within the operating range below a specific flow rate 20 LPM.

Therefore, the water pump of the present disclosure may improve the durability of the water pump by reducing the thrust generated when the impeller rotates, thereby reducing the friction between the rotation shaft of the rotor and the bearing that supports the rotation shaft in the axial direction.

In addition, the upper casing 600 may have an upper bearing mounting part 602 extended from the lower portion of the inlet 610 toward the impeller accommodating space 601, and the upper bearing mounting part 602 may further include a plurality of supports 612. The plurality of supports 612 may be disposed to be spaced apart from each other along the circumferential direction. The plurality of supports 612 may have upper ends connected to an inner wall of the lower end of the inlet 610 and lower ends connected to the upper bearing mounting part 602, and may be formed to extend in a shape in which they are inclined in the inner diameter direction from the upper ends to the lower ends. In addition, the upper bearing mounting part 602 may be formed to be radially inwardly inclined with its upper end going upward, and the plurality of supports 612 may have their lower ends connected to an inclined upper surface of the upper bearing mounting part 602. That is, the upper bearing mounting part 602 may be formed in a shape in which an outer diameter thereof gradually decreases from an approximately intermediate point in a vertical direction toward the upward direction. In addition, an upper bearing 412 may be coupled to the upper bearing mounting part 602, and the upper bearing 412 may include the bushing B capable of radially supporting the upper end of the rotation shaft 410 of the rotor 400 and the support pin P capable of axially supporting the upper end of the rotation shaft 410. In addition, the upper bearing mounting part 602 and the supports 612 may be formed integrally with the upper casing 600 by injection-molding.

In addition, the lower casing 200 may have a rotor accommodating part 220 formed to protrude downwardly from a central portion of the lower seating groove 210, and the rotor accommodating part 220 may be formed in the shape of a container downwardly concave from an upper side thereof. In addition, the rotor accommodating part 220 may have a lower bearing mounting part 222 formed at a lower end of a rotor accommodating space 221, which is a concave inner portion thereof, and a lower bearing 411 may be coupled to the lower bearing mounting part 222. Here, the lower bearing 411 may include a bushing B that may support a lower end of a rotation shaft 410 of the rotor 400 in the radial direction and a spherical ball S that may support the lower end of the rotation shaft 410 in an axial direction. Thus, the rotor 400 may be inserted into and disposed in the rotor accommodating space 221, which is the inner portion of the rotor accommodating part 220, and an outer peripheral surface of the rotor 400 may be disposed to be spaced apart from an inner peripheral surface of the rotor accommodating part 220. In addition, the rotor accommodating part 220 may be formed integrally with the lower casing 200 by injection-molding. In addition, the rotor accommodating part 220 of the lower casing 200 is inserted into a hollowed inside of the stator 100 and penetrates through the stator 100, such that a lower end of the rotor accommodating part 220 may protrude downwardly beyond a lower end of the stator 100, and the lower end of the rotor accommodating part 220 may be in a state in which it is spaced apart from a bottom surface of the motor housing 300. In addition, an outer peripheral surface of the rotor accommodating part 220 may be coupled to an inner peripheral surface of the stator 100 in a state in which it is in contact with and closely adhered to the inner peripheral surface of the stator 100.

In addition, a gap TcC between an outer peripheral surface of an upper end of an inner side of the impeller 500 in the radial direction and the upper casing 600 may be formed to be smaller than or equal to the gap TcB between the lower side of the outer side end of the impeller 500 and the lower bulkhead in the radial direction ($TcC \leq TcB$). Accordingly, the amount of fluid discharged from the outer side end of the impeller 500 in the radial direction and returning to the inlet side of the impeller 500 through the gap between the upper plate 510 of the impeller 500 and the upper casing 600 is reduced, thereby further reducing the generation of the thrust.

In addition, at a position adjacent to the outer side end of the impeller 500 in the radial direction, a gap AcA between the upper surface of the impeller 500 and the lower surface of the upper casing 600 in the axial direction may be formed to be greater than or equal to a gap AcB between the lower surface of the impeller 500 and the upper surface of the lower casing 200 in the axial direction ($AcA \geq AcB$). Thus, the pressure of the fluid between the upper surface of the impeller 500 and the lower surface of the upper casing 600 increases, and as the force of the fluid pressing the impeller 500 downward increases, the generation of the thrust may be reduced.

In addition, a pressure chamber 635 may be formed concavely upward from the lower surface of the upper casing 600 in a portion of the radially inner area based on the upper bulkhead 631 of the upper casing 600. In this case, the pressure chamber 635 may be formed in a form that is concave upward from the upper seating groove 630, and the pressure chamber 635 may be formed to extend radially inward from the upper bulkhead 631. In addition, the pressure chamber 635 may be formed continuously over the entire circumferential direction. Thus, as the pressure of the fluid in the pressure chamber 635 increases, the force that the fluid in the pressure chamber 635 presses the impeller 500 downward increases, thereby reducing the generation of the thrust.

In addition, the upper bulkhead 631 may be disposed radially outward from the lower bulkhead 211. That is, as illustrated, in order to form the gap TcA between the upper bulkhead 631 and the outer peripheral surface of the upper plate 510 of the impeller 500 to be greater than the gap TcB between the outer peripheral surface of the lower plate 520 of the impeller 500 and the lower bulkhead 211, the upper bulkhead 631 may be formed in a form in which it is pushed outward in the radial direction compared to the lower bulkhead 211.

Figure 8:
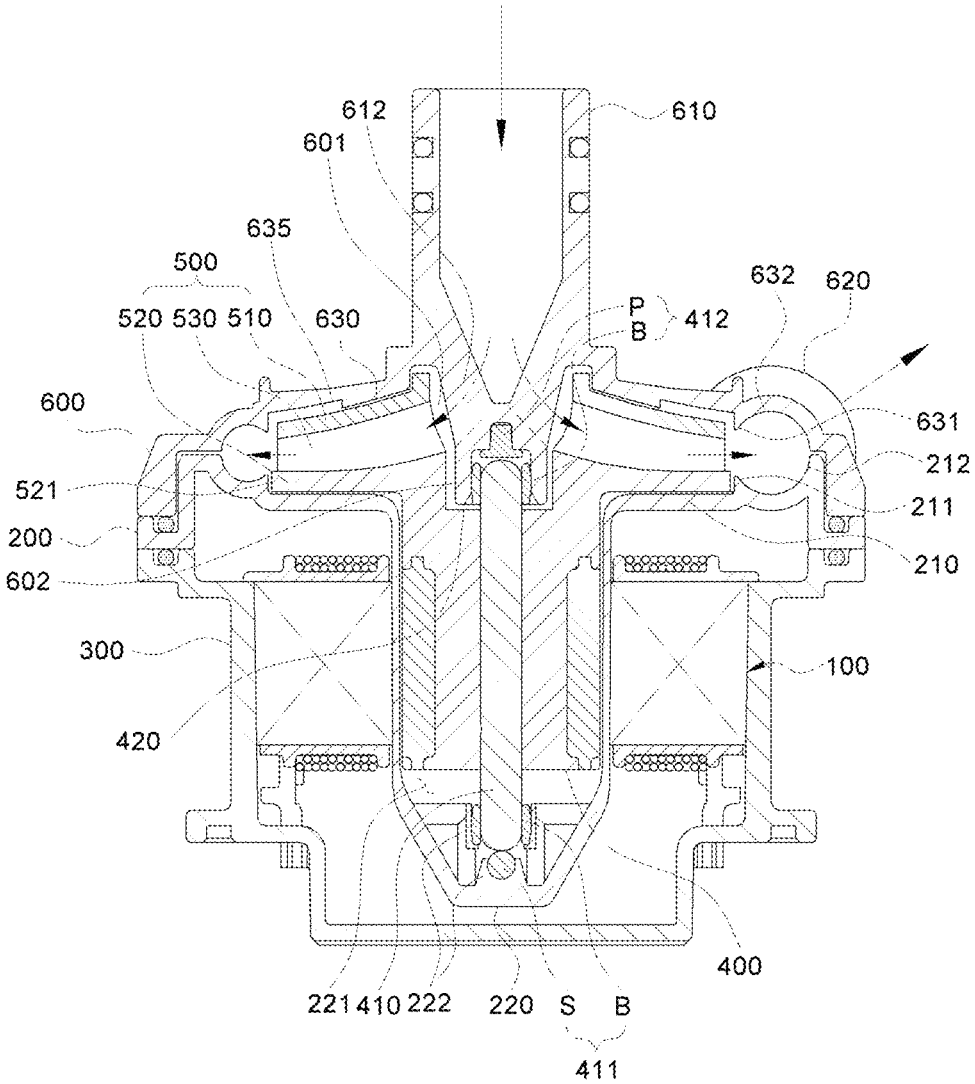
FIG. 8 is a front cross-sectional view illustrating the water pump according to a second embodiment of the present disclosure.
Figure 9:
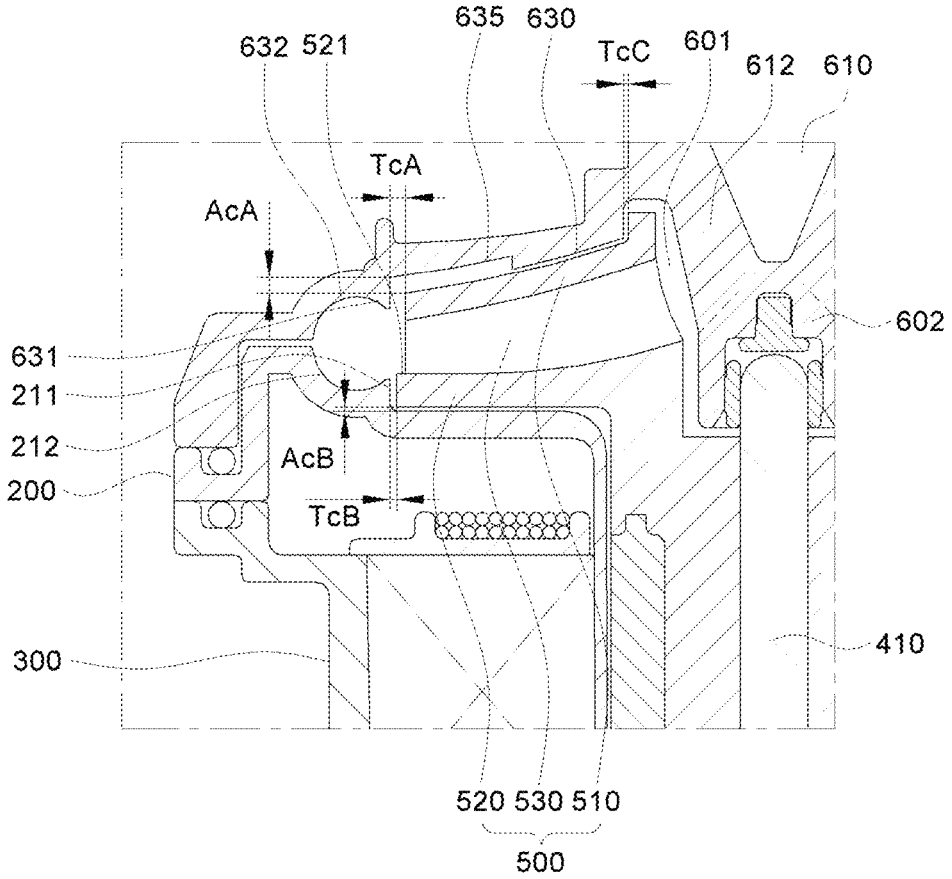
FIG. 9 is a partial enlarged view of FIG. 8.

FIG. 8 is a front cross-sectional view illustrating a water pump according to a second embodiment of the present disclosure, and FIG. 9 is a partial enlarged view of FIG. 8.

As illustrated, in the water pump according to the second embodiment of the present disclosure, in order to form the gap TcA between the upper bulkhead 631 and the outer peripheral surface of the upper plate 510 of the impeller 500 to be greater than the gap TcB between the outer peripheral surface of the lower plate 520 of the impeller 500 and the lower bulkhead 211, the lower plate 520 of the impeller 500 may be formed in the shape that it protrudes radially outwardly more than the upper plate 510 and the impeller 530. Here, the protrusion 521 of the impeller 500 may be formed over the entire circumferential direction, and the outer diameter of the lower plate 520 may be formed to be slightly greater than the outer diameter of the upper plate 510 due to the protrusion 521. Thus, the fluid discharged from the impeller 500 may easily flow between the upper surface of the impeller 500 and the lower surface of the upper casing 600, and as the force of the fluid pressing the impeller 500 downward increases, the generation of the thrust may be reduced.

The motor housing 300 may be coupled to the lower casing 200. The motor housing 300 may be formed in the shape of a concave container made of a metal material, and may be formed in a shape in which an inner portion thereof is empty and an upper side thereof is opened. In addition, the motor housing 300 has a lower end closed and a side surface formed in a cylindrical shape, and an upper end of the motor housing may be provided with a flange protruding outward in the radial direction from the outer circumferential surface.

The stator 100 may have, for example, a shape in which a plurality of teeth are formed to protrude from an inner peripheral surface of a cylindrical core in an inner diameter direction and are disposed to be spaced apart from each other in a circumferential direction, an insulator made of an electrically insulating material surrounds the core and teeth, and coils are wound on an outer side of the teeth surrounded by the insulator. In addition, the stator 100 may have a shape in which a central portion thereof is vertically penetrated. In addition, the stator 100 may be formed in various shapes and configurations. In addition, the stator 100 may be provided in the motor housing 300, and an outer peripheral surface of the stator 100 may be coupled and fixed to an inner peripheral surface of the motor housing 300 in a state in which it is closely adhered to the inner peripheral surface of the motor housing 300.

The rotor 400 may be provided in the rotor accommodating space 221 of the lower casing 200, and the outer peripheral surface of the rotor 400 may be disposed to be spaced apart from the inner peripheral surface of the rotor accommodating part 220, such that the rotor 400 may be rotatably provided. In addition, the rotor 400 has a permanent magnet coupled to an outer portion of the core in the radial direction, and has the rotation shaft 410 coupled to a central axis of the core. In addition, a lower end of the rotation shaft 410 of the rotor 400 may be rotatably coupled to the lower bearing 411, and an upper end of the rotation shaft 410 of the rotor 400 may be rotatably coupled to the upper bearing 412. In addition, a portion or entirety of the upper bearing mounting part 602 may be disposed in an inlet side of the impeller 500. For example, an insertion groove 420 may be formed to be recessed downward at the central portion of the lower plate 520, which is the lower end of the inlet side of the impeller 500, the upper bearing mounting part 602 may be inserted into the insertion groove 420, and the insertion groove 420 and the upper bearing mounting part 602 may be spaced apart from each other.

According to the present disclosure, it is possible to improve the performance and efficiency of the water pump by reducing the thrust generated when the impeller rotates.

In addition, it is possible to improve the durability of the water pump by reducing the friction between the rotation shaft of the rotor and the bearing supporting the rotation shaft in the axial direction.

The present disclosure is not limited to the embodiments described above, and may be applied to various fields. In addition, the present disclosure may be variously modified by those skilled in the art to which the present disclosure pertains without departing from the gist of the present disclosure claimed in the claims.

What is claimed is:

1. A water pump, comprising:

an upper casing and a lower casing that are coupled to each other to form an impeller accommodating space in which an impeller is rotatably accommodated, provided with an inlet communicating with the impeller accommodating space on an upper side of the impeller accommodating space to allow fluid to be introduced, a discharge channel communicating with the impeller accommodating space on an outer side of the impeller accommodating space in a radial direction, and an outlet connected to the discharge channel to discharge the fluid to the outside; and an impeller that is rotatably provided in the impeller accommodating space, wherein the upper casing has an upper bulkhead formed to protrude at a position between the impeller accommodating space and the discharge channel in the radial direction, and the lower casing has a lower bulkhead formed to protrude at a position between the impeller accommodating space and the discharge channel in the radial direction, and a first gap between an upper side of an outer end of the impeller and the upper bulkhead in the radial direction is formed greater than a second gap between a lower side of an outer side end of the impeller and the lower bulkhead in the radial direction.

2. The water pump of claim 1, wherein a third gap between an upper end of an inner side of the impeller and the upper casing in the radial direction is formed to be smaller than or equal to the second gap between the lower side of the outer side end of the impeller and the lower bulkhead in the radial direction.

3. The water pump of claim 1, wherein, in an area adjacent to the position of the outer side end of the impeller in the radial direction, a fourth gap between an upper surface of the impeller and a lower surface of the upper casing in an axial direction is formed to be greater than or equal to a fifth gap between a lower surface of the impeller and an upper surface of the lower casing in the axial direction.

4. The water pump of claim 3, wherein a pressure chamber is formed concavely upward from the lower surface of the upper casing in a portion of an area of the inside in the radial direction based on the upper bulkhead of the upper casing.

5. The water pump of claim 1, wherein the upper bulkhead is disposed radially outward from the lower bulkhead.

6. The water pump of claim 1, wherein the lower side of the outer side end of the impeller in the radial direction protrudes radially outward from the upper side of the outer side end.

7. The water pump of claim 1, wherein the impeller includes an upper plate and a lower plate spaced apart from each other, and a plurality of blades that are interposed and coupled between the upper plate and the lower plate and arranged spaced apart from each other along a circumferential direction, and the upper bulkhead is formed with a height corresponding to the upper plate of the impeller, and the lower bulkhead is formed with a height corresponding to the lower plate of the impeller.

8. The water pump of claim 7, wherein an outer side end of the lower plate of the impeller in the radial direction protrudes radially outward from an outer side end of the upper plate in the radial direction and outer side ends of the plurality of blades in the radial direction.

9. The water pump of claim 1, wherein the impeller is a centrifugal impeller.

10. The water pump of claim 1, further comprising a rotor that is provided in a rotor accommodating part and coupled to the impeller, wherein the lower casing has the rotor accommodating part formed concavely from the upper surface to a lower side in a central portion, and is formed protruding downward.

11. The water pump of claim 10, further comprising:

a motor housing that is formed in a concave container shape with an open upper side and coupled to the lower casing; and a stator that is provided inside the motor housing and coupled to the rotor accommodating part of the lower casing inserted into a central portion.

* * * * *